US007152446B2

(12) United States Patent
Wada et al.

(10) Patent No.: US 7,152,446 B2
(45) Date of Patent: Dec. 26, 2006

(54) METHOD OF FORMING INTERNAL GEAR, AND INTERNAL GEAR

(75) Inventors: Yukio Wada, Sayama (JP); Yasufumi Nakamura, Sayama (JP); Akinao Minegishi, Sayama (JP); Hirofumi Okuda, Sayama (JP)

(73) Assignee: Toyoda Machine Works, Ltd., Kariya (JP)

( * ) Notice: Subject to any disclaimer, the term of this patent is extended or adjusted under 35 U.S.C. 154(b) by 247 days.

(21) Appl. No.: 10/505,351

(22) PCT Filed: Feb. 10, 2003

(86) PCT No.: PCT/JP03/01401

§ 371 (c)(1),
(2), (4) Date: Aug. 19, 2004

(87) PCT Pub. No.: WO03/070397

PCT Pub. Date: Aug. 28, 2003

(65) Prior Publication Data

US 2005/0166654 A1 Aug. 4, 2005

(30) Foreign Application Priority Data

Feb. 21, 2002 (JP) ..... 2002-044352
Dec. 4, 2002 (JP) ..... 2002-352198

(51) Int. Cl.
*B21D 22/00* (2006.01)

(52) U.S. Cl. ..... 72/85; 72/102; 72/109; 72/83; 29/893.32

(58) Field of Classification Search ..... 72/82, 72/83, 84, 85, 102, 109, 115; 29/893.32
See application file for complete search history.

(56) References Cited

U.S. PATENT DOCUMENTS 5,384,949 A * 1/1995 Wodrich et al. ..... 29/557
5,551,270 A * 9/1996 Bajraszewski et al. ..... 72/21.3

(Continued)

FOREIGN PATENT DOCUMENTS

JP 61-222648 10/1986

(Continued)

*Primary Examiner*—Ed Tolan
(74) *Attorney, Agent, or Firm*—Stephen B. Salai, Esq.; Thomas B. Ryan; Harter Secrest & Emery LLP

(57) ABSTRACT

At the time for forming an internal gear from a raw material 2 of an internal gear, first, the raw material 2 is externally inserted onto a forming die 3 and fixed to the forming die 3 through a pressing die 4. Next, a forming roll 5 is moved in a direction as indicated by an arrow B of FIG. 6 while rotating the forming die 3. By this, the inner peripheral surface of the raw material 3 is pressed against an outer gear part 3*b* formed on the outer peripheral surface of the forming die 3 so that an internal gear part 1*c* is formed on the inner peripheral surface of the raw material 2. The rotating direction of the forming die 3 is selected such that the first end part of the outer gear part 3*b* located on the front side in the feeding direction of the forming roll 5 is moved ahead in the rotating direction (the direction as indicated by an arrow A of FIG. 6) of the second end part located on the rear side in the feeding direction of the forming roll 5.

7 Claims, 6 Drawing Sheets

U.S. PATENT DOCUMENTS

| | | | | |
|---|---|---|---|---|
| 6,205,832 | B1 * | 3/2001 | Kostermeier | 72/83 |
| 6,253,589 | B1 * | 7/2001 | Putz et al. | 72/85 |
| 6,269,670 | B1 * | 8/2001 | Koestermeier | 72/85 |
| 6,279,366 | B1 * | 8/2001 | Sakaguchi | 72/102 |
| 6,530,253 | B1 * | 3/2003 | Gotou et al. | 72/85 |

FOREIGN PATENT DOCUMENTS

| | | |
|---|---|---|
| JP | 2-179335 | 7/1990 |
| JP | 9-206869 | 8/1997 |
| JP | 9-220632 | 8/1997 |

* cited by examiner

METHOD OF FORMING INTERNAL GEAR, AND INTERNAL GEAR

This application is a 35 U.S.C. 371 of PCT/JP03/01401 filed Feb. 10, 2003.

TECHNICAL FIELD

This invention relates to a method for forming an internal gear having a helical tooth and an internal gear formed by this forming method.

BACKGROUND ART

One example of a method for forming an internal gear is described in the Official Gazette of Japanese Patent Publication No. H08-11264 and in the Official Gazette of Japanese Patent Application Laid-Open No. H09-206869. In case an internal gear is to be formed by a method described in those Official Gazettes, first, a cylindrical raw material is externally inserted onto a forming die having an outer gear part and fixed thereto. With a forming roll, which is rotatable about its own axis, pressed against the outer peripheral surface of the raw material, the forming roll is moved from one end side of the raw material to the other end side and relatively revolved about the axis of the forming die. By this, the inner peripheral surface of the raw material is pressed against the outer gear part to form an internal gear part corresponding to the outer gear part on the inner peripheral surface of the raw material.

The above conventional method for forming an internal gear has no problem in forming a spur gear whose tooth trace is in parallel relation to the axis of the internal gear. However, when this method is used for forming an internal gear having a helical tooth, a defective flow of the substantial part (solid part) of the gear raw material at the forming time occurs depending on the relation between the helical direction of the tooth and the rotating direction of the forming die. As a result, it is difficult to form an internal gear having a teeth of high precision.

DISCLOSURE OF THE INVENTION

According to a first mode of the present invention, there is provided a method for forming an internal gear in which a cylindrical raw material is externally inserted onto a forming die with an outer gear part formed thereon and fixed to the forming die, a forming roll is relatively moved in an axial direction of the forming die with respect to the raw material with the forming roll press-contacted with an outer peripheral surface of the raw material and relatively revolved about the axis of the forming die such that an inner peripheral surface of the raw material is pressed against the outer gear part of the forming die, thereby forming an internal gear part on the inner peripheral surface of the raw material, wherein each tooth of the outer gear part of the forming die is formed in a helical tooth, an annular weir part having an inside diameter equal to or less than a tooth tip circle diameter of the internal gear part is formed on the inner peripheral surface of the raw material adjacent to a second end part of the outer gear part on a rear side in a moving direction of the forming roll, and the forming die is rotated such that a first end part of the outer gear part on a front side in the moving direction of the forming roll is moved ahead of the second end part of the outer gear part on the weir part side when the forming roll is fixed and the forming die is rotated.

It is preferable that a tooth tip circle diameter and a tooth bottom circle diameter of the outer gear part of the forming die are gradually reduced from one end side on the weir part side toward the other end side of the outer gear part, and the tooth thickness of the outer gear part is gradually reduced from one end side toward the other end side of the outer gear part in correspondence with the tooth tip circle diameter and tooth bottom circle diameter.

It is also preferable that an annular forming surface having a circular configuration in section about an axis of the forming die is formed at a place more offset toward the weir part side from the outer gear part on the outer peripheral surface of the forming die, and the forming roll is relatively revolved with respect to the forming die with the forming roll stopped at a location corresponding to the annular forming surface, so that the inner peripheral surface of the raw material is pressed against the annular forming surface, thereby forming an annular reference surface on the inner peripheral surface of the internal gear.

It is also preferable that the forming roll is relatively revolved in the normal and reverse directions at the time the forming roll is relatively revolved with respect to the forming die with the forming roll stopped at a location corresponding to the annular forming surface.

It is also preferable that the forming roll is separated in the radial direction from an outer peripheral surface of the cylindrical part before the forming roll is escaped from the outer peripheral surface of the raw material on the front side in the moving direction of the forming roll.

It is also preferable that the forming roll is relatively revolved a plurality of times with the forming roll stopped at a location where the forming roll is separated in the radial direction from the outer peripheral surface of the raw material.

According to a second mode of the present invention, there is provided an internal gear including a cylindrical part formed at an inner peripheral surface thereof with an internal gear part having a helical tooth part, and a bottom part formed on one end part of the cylindrical part, wherein the internal gear part is formed on the inner peripheral surface of the internal gear and the annular reference surface is formed on the inner peripheral surface of the internal gear part between the bottom part and the internal gear part in accordance with the following forming methods A and B.

A. A method for forming an internal gear is employed in which a cylindrical raw material is externally inserted onto a forming die formed with an outer gear part and fixed thereto, a forming roll is relatively moved in the axial direction of the forming die with respect to the raw material with the forming roll press contacted with the outer peripheral surface of the raw material and relatively revolved about the axis of the forming die, so that the inner peripheral surface of the raw material is pressed against the outer gear part of the forming die, thereby forming an internal gear part on the inner peripheral surface of the raw material, each tooth of the outer gear part of the forming die is formed in a helical tooth, and an annular weir part having an inside diameter equal to or less than a tooth tip circle diameter of the internal gear part is formed on the inner peripheral surface of the raw material adjacent to a second end part of the outer gear part on a rear side in a moving direction of the forming roll, and the forming die is rotated such that a first end part of the outer gear part on a front side in the moving direction of the forming roll is moved ahead of the second end part of the outer gear part on the weir part side when the forming roll is fixed and the forming die is rotated, thereby forming the internal gear part.

B. Said forming die is formed at a place more offset toward the weir part side from the outer gear part on the outer peripheral surface with an annular forming surface having a circular configuration in section about an axis of the forming die, and the forming roll is relatively revolved with respect to the forming die with the forming roll stopped at a location corresponding to the annular forming surface, so that the inner peripheral surface of the raw material is pressed against the annular forming surface, thereby forming an annular reference surface on the inner peripheral surface of the internal gear.

BEST MODE FOR CARRYING OUT THE INVENTION

The best modes for carrying out the invention will be described hereinafter with reference to FIGS. 1 through 7.

Figure 1:
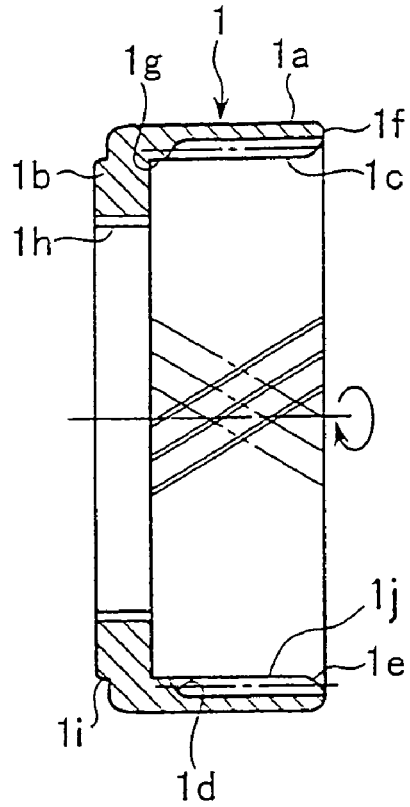
FIG. 1 is a side sectional view showing one example of an internal gear formed by a forming method according to the present invention.

First, an internal gear formed in accordance with a forming method of the present invention will be described. FIG. 1 is a vertical sectional view taken by a plane including an axis of an internal gear formed by a forming method of the present invention. The internal gear 1 shown in FIG. 1 comprises a cylindrical part 1*a* having constant inside and outside diameters, and a bottom part 1*b* integrally formed with one end part of the cylindrical part 1*a*. Of the entire inner peripheral surface of the cylindrical part 1*a*, the range of area from an open end of the cylindrical part 1*a* to the vicinity of the bottom part 1*c* is formed with an internal gear part 1*c*. This internal gear part 1*c* is formed such that its axis is aligned with that of the cylindrical part 1*a*. The internal gear part 1*c* includes a helical tooth. The helical direction of each tooth of the internal gear part 1*c* is set such that when the internal gear 1 is rotated in the clockwise direction (the direction as indicated by an arrow of FIG. 1) as viewed in the direction of the bottom part 1*b* side, the end part, on the opening part side of the internal gear 1, of each tooth of the internal gear part 1*c* is moved ahead in the rotating direction of the end part on the bottom part 1*b* side. Of course, the helical direction of the internal gear part 1*c* may be in the reversed direction to the direction of this first mode of the invention.

The end part on the bottom part 1*b* side of the internal gear part 1*c* is formed in a tapered part 1*d* which is inclined in such a manner as to approach the bottom part 1*b* toward the tooth tip side from the tooth bottom side. On the other hand, the end part of the internal gear part 1*c* on the opening part side of the internal gear 1 is defined as an incomplete tooth part 1*e* having a generally circular configuration in section. One end of the incomplete tooth part 1*e* on the bottom part 1*b* side is smoothly contacted with a tooth tip surface (inner peripheral surface) 1*j* of the internal gear part 1*c*, and the other end of the incomplete tooth part 1*e* on the opening part side of the internal gear 1 is intersected with an end face 1*f* on the opening side of the cylindrical part 1*a* at the tooth bottom or at a place offset toward the outer periphery side of the cylindrical part 1*a* from the tooth bottom.

At a place between the internal gear part 1*c* on the inner peripheral surface of the cylindrical part 1*a* and the bottom part 1*b*, an annular reference surface (weir part) 1*g* which is short in length is formed. This reference surface 1*g* is formed such that its axis is aligned with the axes of the cylindrical part 1*a* and the internal gear part 1*c*, and it has an inside diameter equal to the tooth tip circle (inside diameter of the internal gear part 1*c*) of the internal gear part 1*c*. The reference surface 1*g* may be more reduced or enlarged in diameter than the tooth tip circle of the internal gear part 1*c*. In case the inside diameter of the reference surface 1*g* is made equal to or less than that of the internal gear part 1*c*, the reference surface 1*g* can also serve as a weir. However, in case the inside diameter of the reference surface 1*g* is made larger than that of the tooth tip circle of the internal gear part 1*c*, the reference surface 1*g* cannot serve as a weir. In such a case, it is necessary that the reference surface 1*g* is arranged in such a manner as to be separated away from the internal gear part 1*c* toward the bottom part 1*b* side, and an annular weir part having an inside diameter equal to or less than the diameter of the tooth tip circle of the internal gear part 1*c* and with its axis aligned with that of the internal gear part 1*c* is formed, as a separate body, at a place adjacent to the internal gear part 1*c* between the reference surface 1*g* and the internal gear 1*c*. The operation of the reference surface 1*g* and the weir which is also commonly served by the reference surface 1*g* will be described later.

A spline hole 1*h* is formed at a central part of the bottom part 1*b*. The spline hole 1*h* is formed such that it pierces the bottom part 1*b* and its axis is aligned with those of the cylindrical part 1*a* and the internal gear part 1*c*. The axis of the spline hole 1*h* can be made in alignment with that of the internal gear part 1*c* by machining the spline hole 1*h*, for example, by a pinion cutter with the internal gear 1 positioned and fixed with reference to the reference surface 1*g*, or by broach machining the spline hole 1*h* following its reference inside diameter after the reference inside diameter of the spline hole 1*h* is formed. An annular protrusion 1*i* is formed on an end face opposite to the cylindrical part 1*a* of the bottom part 1*b*. This annular protrusion 1*i* has a smaller outside diameter than that of the cylindrical part 1*a*, and it is formed such that its axis is aligned with that of the cylindrical part 1*a*.

Figure 2:
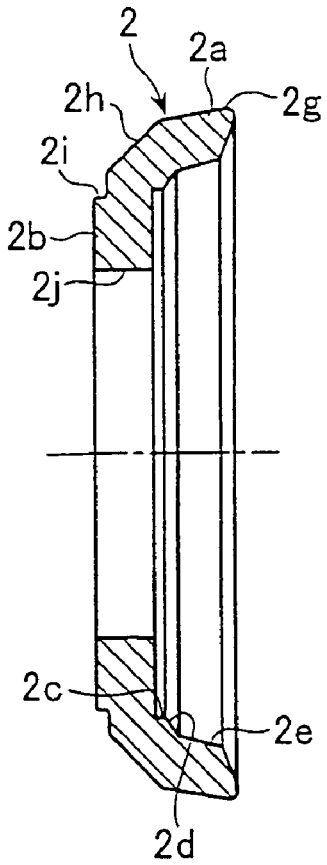
FIG. 2 is a side sectional view showing a raw material which is used when the internal gear shown in FIG. 1 is formed by a forming method according to the present invention.

Next, a method for forming the internal gear 1 will be described. FIG. 2 is a sectional view showing a raw material 2 which is used at the time for forming the internal gear 1. This gear raw material 2 has a bottomed cylindrical configuration as a whole. The gear raw material 2 includes a tapered cylindrical part 2*a* and a bottom part 2*b* integrally formed with the end part on the reduced-diameter side of the cylindrical part 2*a*.

The cylindrical part 2*a* is formed at an inner peripheral part thereof with the reference surface forming part 2*c*, the tapered part 2*d* and the internal gear forming part 2*e* which are all formed in this order from the bottom part 2*b* side toward the opening part side of the cylindrical part 2*a* such that the axes of them are aligned with the axis with the cylindrical part 2*a*. The reference surface forming part 2*c* is formed as a straight hole having a circular configuration in section which is short in length. The length of the reference surface forming part 2*c* is set to be generally equal to the length of the reference surface 1*g* of the internal gear 1, and the inside diameter of the part 2*c* is set to be generally equal to or slightly larger than that of the reference surface 1*g*. The tapered part 2*d* has a same taper angle as the tapered part 1*d* and is gradually enlarged in diameter from the reference surface forming part 2*c* toward the opening part side of the cylindrical part 2*a*. Accordingly, the inside diameter of the reduced-diameter side end part of the tapered part 2*d* is equal to that of the reference surface forming part 2*c*. On the other hand, the inside diameter of the enlarged-diameter side end part of the tapered part 2*d* is set to be generally equal to or slightly larger than the tooth tip circle diameter of the internal gear part 1*c*. The internal gear forming part 2*e* extends from the tapered part 2*d* to the opening end of the cylindrical part 2*a* while being gradually enlarged in diameter with a smaller taper angle than the tapered part 2*d*. Accordingly, the inside diameter of the reduced-diameter side end part of the internal gear forming part 2*e* is equal to or slightly larger than the tooth bottom circle diameter of the internal gear part 1*c*, and the inside diameter of the enlarged-diameter side end part of the internal gear forming part 2*e* is larger than the tooth bottom circle diameter of the internal gear part 1*c*. Instead of being formed into a tapered state, the internal gear forming part 2*e* may be formed as a straight hole having a slightly larger diameter than the tooth bottom circle diameter of the internal gear part 1*c*.

The outer peripheral surface 2*g* of the cylindrical part 2*a* has a generally same taper angle as the internal gear forming part 2*e*. Accordingly, the cylindrical part 2*a* is generally constant in thickness at its part corresponding to the internal gear forming part 2*e*. The thickness of the cylindrical part 2*a* at its part corresponding to the internal gear forming part 2*e* and the length of the cylindrical part 2*a* are determined taking into consideration of the axial elongation of the cylindrical part 2*a* at the time of completion of forming the internal gear part 1*c* on the inner peripheral surface of the cylindrical part 2*a*. A biting part 2*h*, which is gradually enlarged in diameter from the bottom part 2*b* side toward the cylindrical part 2*a* side, is formed on the outer peripheral surfaces at the intersecting part between the cylindrical part 2*a* and the bottom part 2*b*. The taper angle of this biting part 2*h* is set to be generally equal to that of the tapered part 2*d*. Accordingly, the thickness of the intersecting part between the cylindrical part 2*a* and the bottom part 2*b* is generally constant and generally equal to that of the cylindrical part 2*a*.

An annular protrusion 2*i* is formed on the opposite end face to the cylindrical part 2*a* side of the bottom part 2*b* such that its axis is aligned with that of the cylindrical part 2*a*. This annular protrusion 2*i* has the same dimension as the annular protrusion 1*i* of the internal gear 1, but the length in the axial direction of the annular protrusion 2*i* may be set to be longer by its finishing portion than that of the annular protrusion 1*i*. A prepared hole 2*j* is formed at a central part of the bottom part 2*b* such that the prepared hole 2*j* pierces the bottom part 2*b*. The inside diameter of this prepared hole 2*j* is more reduced in diameter by a finishing width portion at the time of pinion cutter or broach machining than the inside diameter (tooth tip circle diameter) of the spline hole 1*h*.

Figure 3:
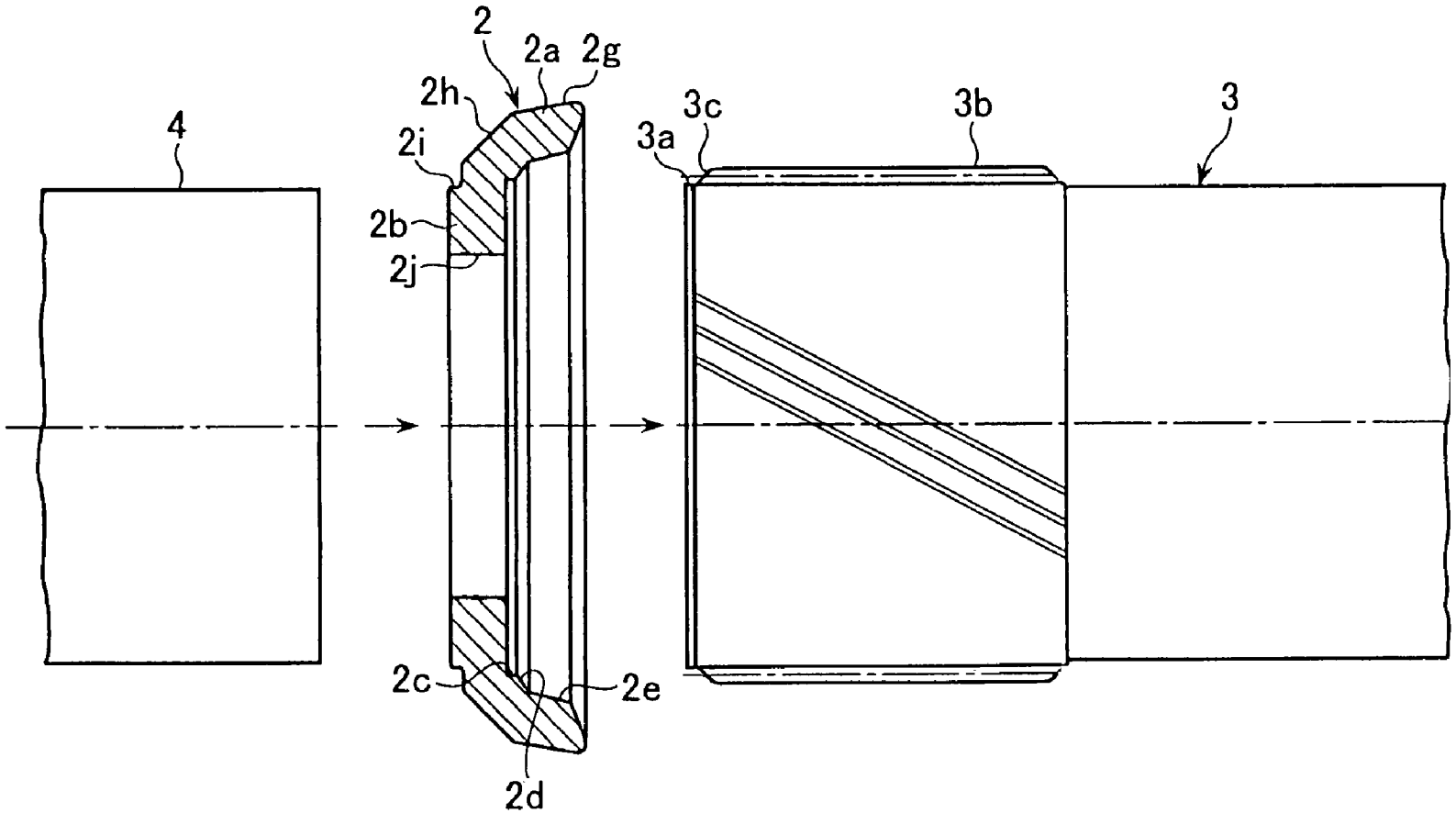
FIG. 3 is a side sectional view showing a forming die, a raw material and a pressing die which are used in a forming method according to the present invention.
Figure 4:
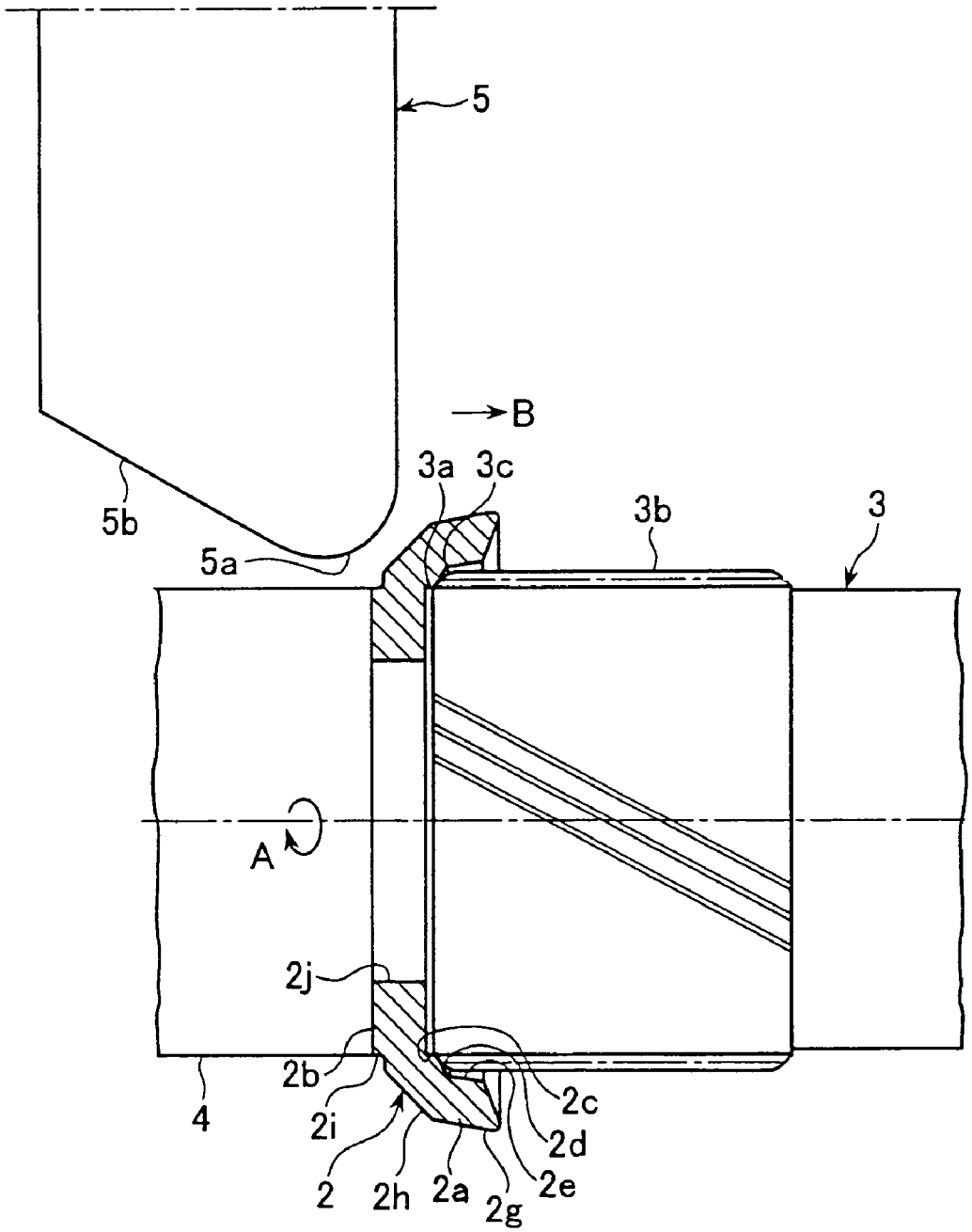
FIG. 4 is a side sectional view showing a standby state of a forming roll for forming a raw material which is fixed to the forming die shown in FIG. 3 by the pressing die.

In case the internal gear 1 is formed from the raw material 2, a forming die 3, a pressing die 4 and a forming roll 5 are used as shown in FIGS. 3 and 4.

The forming die 3 has a circular shaft-like configuration in section and is rotated in the normal and reverse directions about its axis by rotation driving means (not shown). An annular forming surface 3*a* and an outer gear part 3*b* are sequentially formed on the outer peripheral surface of the forming die 3 from one end (left end in FIG. 3) of the forming die 3 toward the other end side with their axes aligned with the axis of the forming die 3. The annular forming surface 3*a* has the same dimension as the reference surface 1*g* of the internal gear 1. The outer gear part 3*b* has the same helical angle as the internal gear part 1*c*. A tooth part of the outer gear part 3*b* as its solid part and a tooth groove part of the outer gear part 3*b* as its space part have the generally same configurations as the tooth groove part and the tooth part of the internal gear part 1*c*. More specifically, the tooth tip circle diameter (outside diameter), the tooth bottom circle diameter, the tooth thickness and the tooth gap of the outer gear part 3*b* at the end part connecting with the annular forming surface 3*a* are same in dimension as the tooth bottom circle diameter, the tooth tip circle diameter, the tooth gap and the tooth thickness of the internal gear part 1*c*, respectively. However, the tooth tip circle diameter and the tooth bottom circle diameter of the outer gear part 3*b* are slightly reduced from one end side of the forming die 3 toward the other end side. In correspondence with this, the tooth thickness of the outer gear part 3*b* is also slightly reduced from one end side of the forming die 3 toward the other end side. The length of the outer gear part 3*b* is set to be sufficiently longer than the length of the internal gear part 1*c*. The end part adjacent to the annular forming surface 3*a* of the outer gear part 3*b* is formed as a tapered part 3*c*. This tapered part 3*c* has the same dimension as the tapered part 1*d* of the internal gear 1.

The pressing die 4 has a circular shaft-like configuration in section, and its outer diameter is generally equal to the outside diameter (equal to the outside diameter of the annular protrusion 2*i* of the raw material 2) of the annular protrusion 1*i* of the internal gear 1. The pressing die 4 is movable in the directions toward and away from the forming die 3 and rotatable about its axis with its axis aligned with that of the forming die 3.

The forming roll 5 has a disc-like configuration and arranged such that its axis is parallel to that of the forming die 3. The forming roll 5 may be arranged such that its axis is in a helical positional relation to that of the forming die 3. The forming roll 5 is arranged such that it is rotatable about its own axis and movable in the axial direction of the forming die 3. An arcuate part 5*a* and a release part 5*b* are formed on the outer peripheral surface of the forming roll 5. The arcuate part 5*a* has a generally quarterly arcuate configuration in section and arranged at a front end part in the moving direction (the direction as indicated by an arrow B of FIG. 4) of the forming roll 5 at the time of forming the internal gear 1. One end part of the arcuate part 5*a* is connected with an end face 5*c* of the forming roll 5 directing in the direction as indicated by the arrow B. The other end of the arcuate part 5*a* is connected with the release part 5*b*. The release part 5*b* extends from the arcuate part 5*a* to the other end face 5*d* of the forming roll 5 and is gradually reduced in diameter from the arcuate part 5*a* toward the other end face 5*d* side. The minimum distance between the arcuate part 5*a* and the axis of the forming die 3 is set to be equal to one-half of the outside diameter of the cylindrical part 1*a* of the internal gear 1.

In case the internal gear 1 is to be formed using the raw material 2, the forming die 3, the pressing die 4 and the forming roll 5, the raw material 2 is externally inserted onto one end part (left end part in FIG. 4) of the forming die 3 as shown in FIGS. 3 and 4. Then, the annular forming surface 3*a* of the forming die 3 is fitted to the reference surface forming part 2*c* of the raw material 2 until one end face of the forming die 3 is contacted with the bottom part 2*b*. By this, the axis of the cylindrical part 2*a* of the raw material 2 is generally aligned with the axis of the forming die 3. Thereafter, the pressing die 4 is moved toward the forming die 3 so that the bottom part 2*b* of the raw material 2 is fixedly sandwiched between the left end face of the forming die 3 and the right end face of the pressing die 4 in FIG. 4. By this, the raw material 2 is fixed to the forming die 3. On the other hand, the forming roll 5 is, as shown, located at a place separated away toward the rear side (opposite side to the direction as indicated by the arrow B of FIG. 4) in the moving direction at the forming time with respect to the raw material 2 which is fixed to the forming die 3.

Subsequently, the forming die 3 is driven for rotation about its axis. In this case, the forming die 3 is driven for rotation in the direction as indicated by the arrow A of FIG. 4 so that a first end part (hereinafter, this end part is referred to as the front side end part) of each tooth of the outer gear part 3*b* located on the front side in the moving direction (the direction as indicated by the arrow B) of the forming roll 5 is moved ahead of a second end part (hereinafter, this end part is referred to as the rear side end part) of the outer gear part located at the rear side (reference surface (weir part) 1*g* side) in the moving direction. When the forming die 3 is driven for rotation, the raw material 2 and the pressing die 4 are rotated in the same direction following the forming die 3. Thereafter, the forming roll 5 is moved in the direction as indicated by the arrow B. The forming roll 5 thus moved in the direction as indicated by the arrow B, is contacted with the biting part 2*h* of the raw material 2, first. When the forming roll 5 is contacted with the raw material 2, the forming roll 5 is rotated about its own axis by a frictional resistance between the forming roll 5 and the raw material 2 in accordance with the rotation of the raw material 2. Moreover, since the raw material 2 is rotated, it is relatively revolved with respect to the raw material 2. Thereafter, when the forming roll 5 is further moved in the direction as indicated by the arrow B, a part of the entire raw material 2 from the contacting part with the biting part 2*h* of the forming roll 5 to the front side part in the moving direction is formed into the cylindrical part 1*a* by the forming roll 5 in accordance with the movement of the forming roll 5.

When the place closest to the outer periphery of the forming roll 5 of the entire arcuate part 5*a* of the forming roll 5, is brought to a location opposing to the annular forming surface 3*a* of the forming die 3, the forming roll 5 is temporarily stopped moving in the direction as indicated by the arrow B. The forming die 3 is rotated while maintaining that condition. The reference surface forming part 2*c* of the raw material 2 is pressed against the annular forming surface 3*a* of the forming die 3. By this, the reference surface 1*g* of the internal gear 1 is formed. At the time of forming the reference surface 1*g*, the forming die 3 is preferably rotated a plurality of times. Particularly preferably, the forming die 3 is rotated a plurality of times in the normal and reverse directions, respectively. By doing so, the reference surface forming part 2*c* of the raw material 2 can be contacted well with the annular forming surface 3*a* of the forming die 3 and the reference surface 1*g* can be enhanced in precision.

Figure 5:
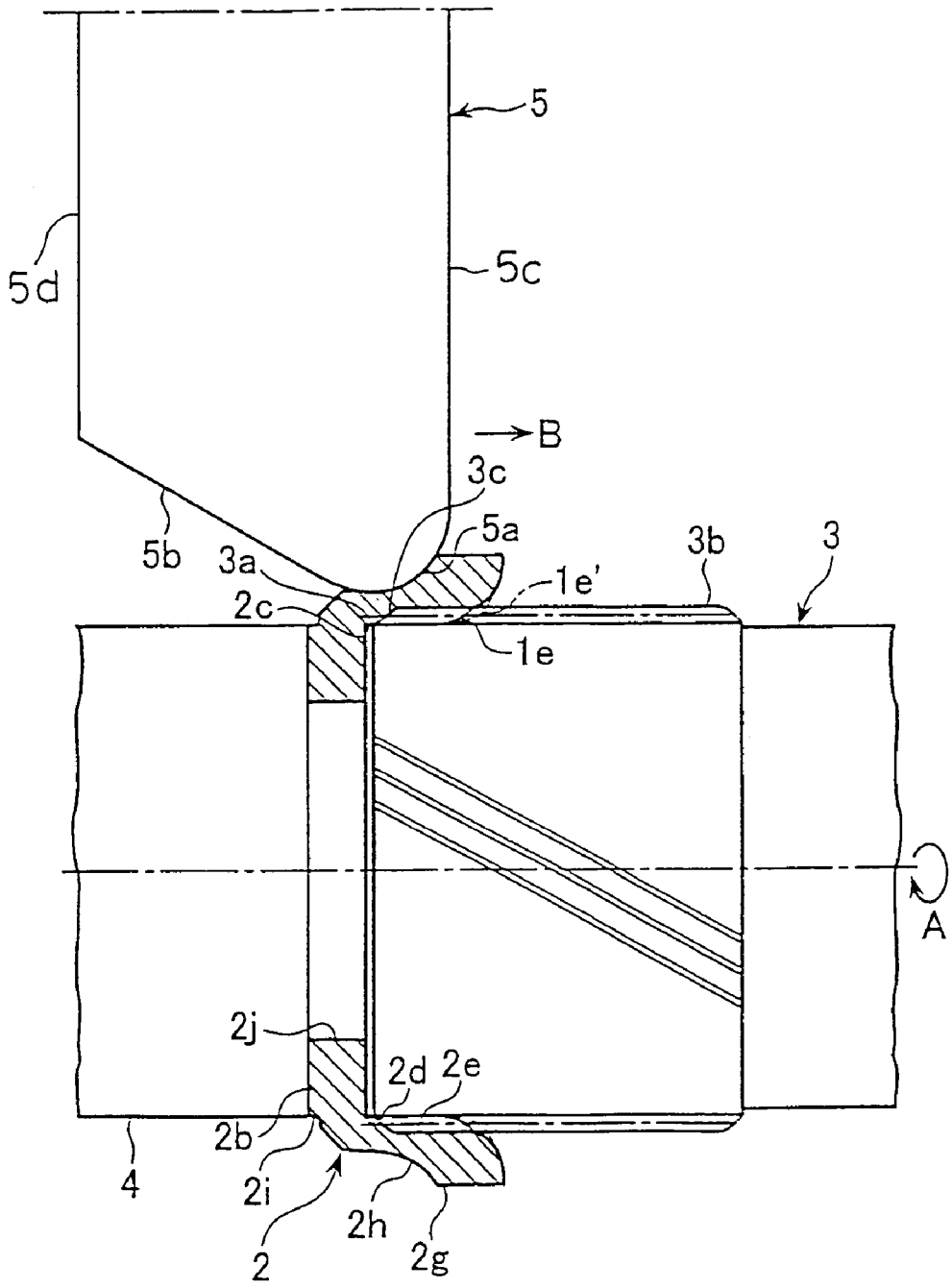
FIG. 5 is a side sectional view showing a state in which a reference surface of the internal gear is being formed by the forming roll.
Figure 6:
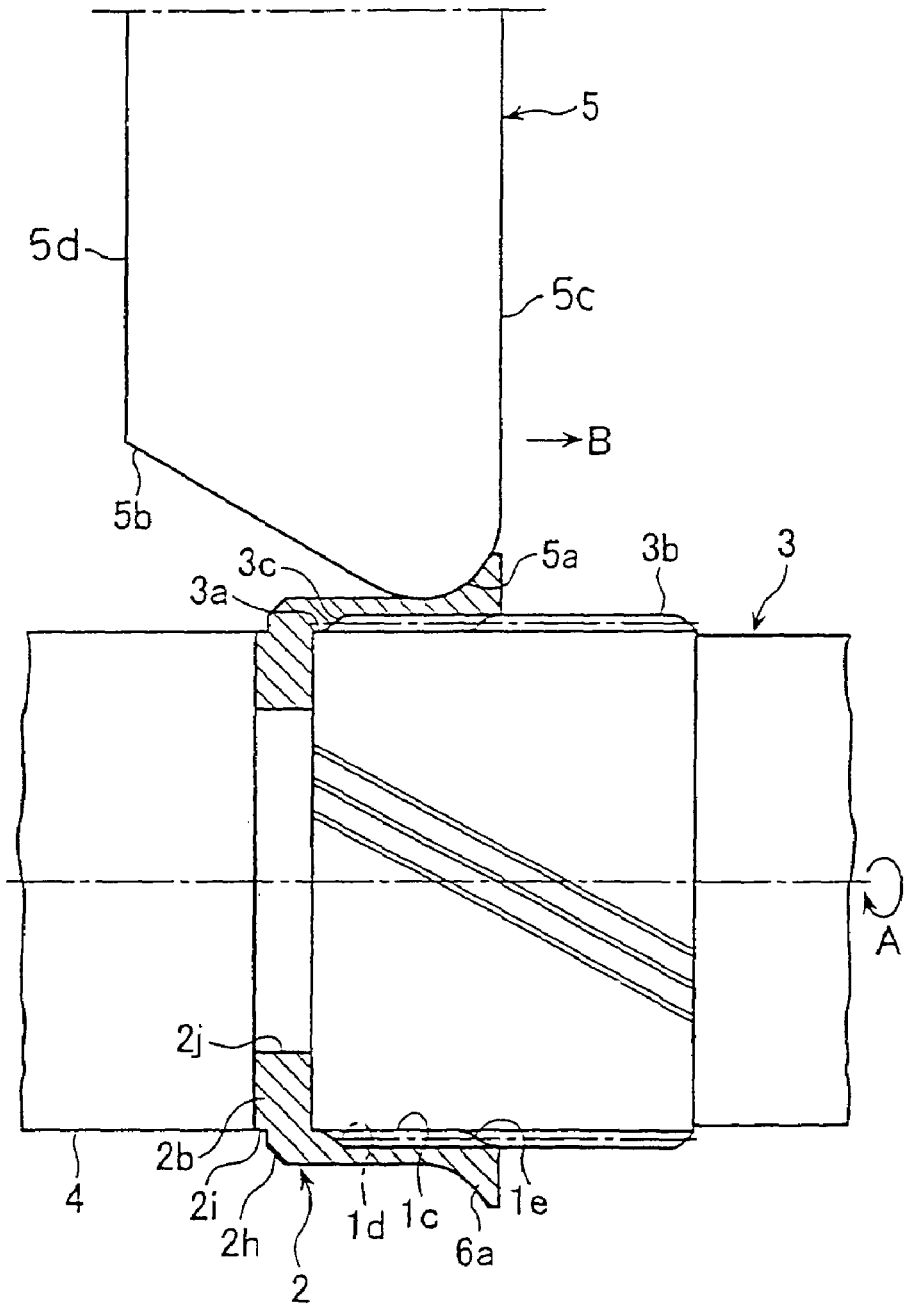
FIG. 6 is a side sectional view showing a state immediately before the completion of the forming process of the internal gear by using the forming roll.

Thereafter, the forming roll 5 is moved in the direction as indicated by the arrow B again and the forming die 3 is rotated in the direction as indicated by the arrow A of FIGS. 4 through 6. Then, the cylindrical part 2*a* of the raw material 2 is formed as the cylindrical part 1*a* of the internal gear 1, and the internal gear part forming part 2*e* of the raw material 2 is pressed against the outer gear part 3*b* of the forming die 3. By this, the internal gear part 1*c* is formed. That is, the tooth part of the outer gear part 3*b* is bitten into the internal gear part forming part 2*e* to thereby form the tooth groove part of the internal gear part 1*c*. Simultaneous with this, the solid part (substantial part) of the raw material 2 corresponding to a biting portion of the tooth part of the outer gear part 3*b* is flowed into the tooth groove part of the outer gear part 3*b* to thereby form the tooth part of the internal gear part 1*c*. In this case, a part of the solid part of the raw material 2 flown into the tooth groove part of the outer gear part 3*b* remains there but a part of the remainder tends to flow along the tooth groove of the outer gear part 3*b*.

Presuming that the forming die 3 is rotated such that the front side end part of the outer gear part 3*b* in the feeding direction of the forming roll 5 is located at a back side position in the rotating direction (the direction as indicated by the arrow A) of the forming die 3 against the rear side end part of the outer gear part 3*b*, in other words, when the forming die 3 is rotated in the reverse direction to the direction as indicated by the arrow A, a large part of the solid part of the raw material 2 flown into the tooth groove part of the outer gear part 3*b* is flown toward the opening part side of the raw material 2. As a result, the solid part of the raw material 2 is not sufficiently filled in the entire tooth groove part of the outer gear part 3*b*, and a sag or the like may be generated at the tooth part of the internal gear part 1*c* thus formed. Moreover, as indicated by a phantom line of FIG. 5, an incomplete tooth part 1*e*' having an uneven length in the axial direction of the internal gear part 1*c* is formed on the internal gear forming part 2*e* located on a front side of the forming roll 5 by the solid part of the raw material 2 flown into the tooth groove part of the outer gear part 3*b*.

In this respect, in the forming method of the present invention, since the forming die 3 is rotated in the direction as indicated by the arrow A so that the front side end part of the outer gear part 3*b* in the feeding direction of the forming roll 5 is moved ahead of the rear side end part of the outer gear part 3*b* in the rotating direction of the forming die 3, the large part of the solid part of the raw material 2 flown into the tooth groove part of the outer gear part 3*b* is flown backward under the feeding effect of each tooth of the outer gear part 3*b*. Then, since the reference surface (weir part) 1*g* is formed at a place adjacent to the rear side end part of the internal gear part 1*c*, the solid part trying to flow backward is received by the reference surface 1*g*. As a result, the solid part of the raw material 2 is sufficiently filled in the entire tooth groove part of the outer gear part 3*b*. Hence, a tooth part, which is free from sag or the like and which is high in precision, is formed as a tooth part of the internal gear part 1*c*. In this way, formation of the tooth part of the internal gear part 3*b* made by the forming roll 5 is consecutively performed in accordance with the movement of the forming roll 5. Accordingly, the internal gear part 1*c* is formed with high precision over its entirety. Moreover, since only a part of the solid part of the raw material 2 is flown toward the opening part side of the raw material 2, the length of the incomplete tooth part 1*e* formed by the solid part can be reduced.

Figure 7:
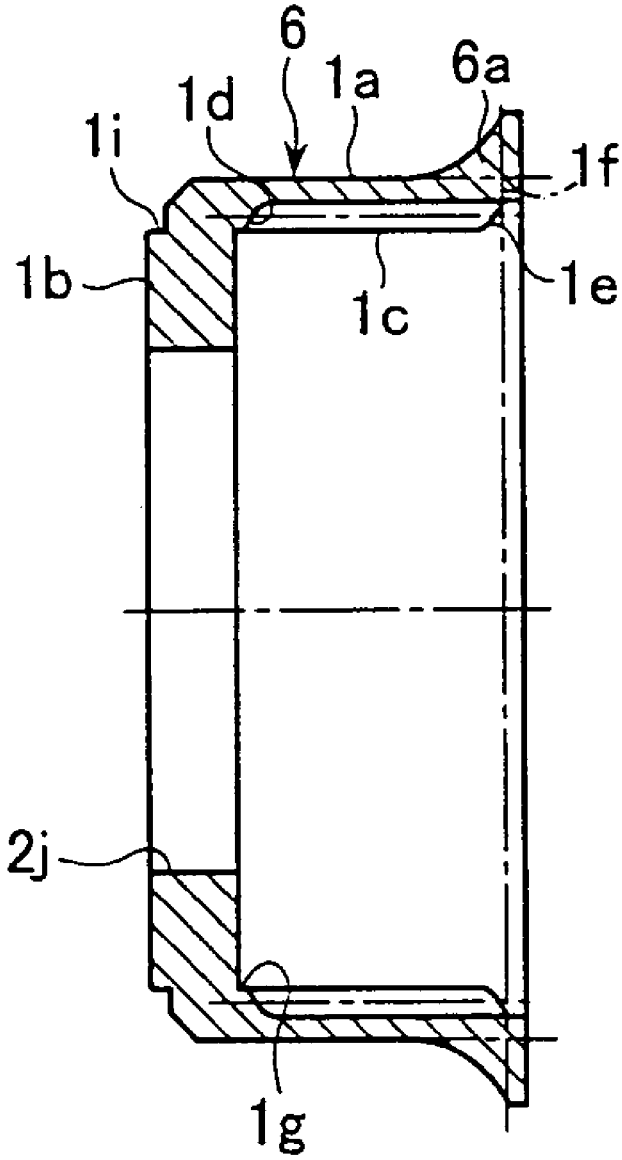
FIG. 7 is a side sectional view showing an internal gear formed body obtained by removing the raw material formed by the forming roll from the forming die.

As shown in FIG. 6, when the forming roll 5 is brought to a place immediately before being escaped from the raw material 2 and as a result, the incomplete tooth part 1*e* is brought to a place immediately before reaching the end face of the opening part of the raw material 2, the feeding movement in the direction as indicated by the arrow B of the forming roll 5 is stopped. In that condition, the forming die 3 is rotated a plurality of times. By this, the internal gear part 1*c* and the cylindrical part 1*a* can be enhanced in roundness. Thereafter, the forming roll 5 is moved radially outwardly of the forming die 3 so that it can be separated away from the raw material 2. When the forming roll 5 is separated away from the raw material 2, the pressing die 4 is moved away from the raw material 2 and the raw material 2 is removed from the forming die 3. By doing so, an entire internal gear forming body 6 as shown in FIG. 7 can be obtained. The internal gear forming body 6 has the same configuration as the internal gear 1 only excepting a non-formed part as a left non-formed part of the raw material 2 by the forming roll 5 and the prepared hole 2*j*.

Although the tooth tip circle diameter, the tooth bottom circle diameter and the tooth thickness of the forming die 3 are reduced from one end part on the annular forming surface 3*a* side toward the other side, the opening part side of the raw material 2 is enlarged in diameter by spring back when the forming roll 5 is separated away from the raw material 2. As a result, the tooth tip circle diameter, the tooth bottom circle diameter and the tooth groove width of the internal gear part 1*c* thus formed are increased. Accordingly, the raw material 2 can easily be removed from the forming die 3. Moreover, increasing amounts of the tooth tip circle diameter, the tooth bottom circle diameter and the tooth groove width of the internal gear part 1*c* caused by spring back correspond to amounts by which the tooth tip circle diameter, the tooth bottom circle diameter and the tooth thickness of the outer gear part 3*b* are reduced from one end part on the annular forming surface 3*a* side toward the other end side. Accordingly, the internal gear part 1*c* becomes generally constant in tooth tip circle diameter, tooth bottom circle diameter, tooth thickness and tooth groove width from its one end toward the other end.

In case the internal gear forming body 6 is to be formed into the internal gear 1, the outer surface of the non-formed part 6*a* is cut off until its outside diameter becomes equal to the outside diameter of the cylindrical part 1*a* and the end face of the non-formed part 6*a* is cut off along a plane orthogonal to the axis of the internal gear forming body 6 so that the dimension between the end face of the non-formed part 6*a* and the left end face of the annular protrusion 1*i* becomes equal to the dimension between the end face 1*f* of the internal gear 1 and the end face of the annular protrusion 1*i*. By this, the end face 1*f* of the internal gear 1 is formed. This end face 1*f* is in contact with the tooth bottom of the incomplete tooth part 1*e* (internal gear part 1*c*) or slightly spaced apart rightward in FIG. 7 from the tooth bottom of the incomplete tooth part 1*e*. In this way, in case the end face of the incomplete part 6*a* is cut off so that the end face 1*f* will not intersect the tooth bottom of the internal gear part 1*c*, burr can be prevented from being generated at the end part of the internal gear part 1*c*. That is, 1*f* the internal gear part 1*c* should be formed up to the opening part side end part of the raw material 2, burr would be generated at the end part of the internal gear part 1*c* because the end part of the internal gear part 1*c* would be intermittently cut by a cutter when the end part of the raw material 2 is cut off in order to form the end face 1*f*. In this embodiment, however, since the end face 1*f* is in contact with the tooth bottom of the incomplete tooth part 1*e* or slightly spaced apart from the incomplete tooth part 1*e*, the internal gear part 1*c* is never cut in order to form the end face 1*f* at the time of cutting the end face of the non-formed part 6*a*. Accordingly, burr can surely be prevented from being generated at the end part of the internal gear part 1*c*. Either of the cutting-off of the outer peripheral surface of the non-formed part 6*a* and the cutting-off of the end face of the non-formed part 6*a* may be carried out first.

The prepared hole 2*j* of the internal gear forming body 6 is formed into the spline hole 1*h* by pinion cutter or broach machining. At that time, the internal gear forming body 6 is positionally fixed with reference to the reference surface 1*g* and the pinion cutter machining, broach machining or the like is carried out. By doing so, the axis of the spline hole 1*h* can correctly be aligned with the axis of the internal gear part 1*c*. Machining of the prepared hole 2*j* may be carried out before or after the cutting-off machining of the non-formed part 6*a* is carried out.

The internal gear 1 is preferably subjected to surface hardening treatment after the completion of machining. Particularly, the internal gear part 1*c* is preferably subjected to surface hardening treatment. As the surface hardening treatment, there can be listed, for example, soft-nitriding treatment, nitriding treatment, carbonizing and quenching treatment, carbonizing and nitriding treatment, tempering and quenching treatment, and the like.

In the internal gear 1 formed in the manner as described above, the axis of the spline hole 1*h* can correctly be aligned with the axis of the internal gear part 1*c* at the time of broach machining the spline hole 1*h* to the bottom part 1*b* as previously mentioned. Moreover, the internal gear part 1*c* can be enhanced in precision and the length of the incomplete tooth part 1*c* in the axial direction of the internal gear 1 can be reduced. If it is a main object to merely enhance the precision of the internal gear 1, it can be contemplated that the internal gear part 1*c*, for example, is machined by a pinion cutter. However, in case the internal gear part 1*c* is machined by a pinion cutter, it is necessary to form an annular recess groove whose diameter is larger than the tooth bottom circle diameter of the internal gear part 1*c* on the inner peripheral surface of the internal gear 1 between the internal gear part 1*c* and the bottom part 1*b*. Formation of such a recess groove results in reduced strength of the internal gear 1 because the part of the internal gear 1 where the recess groove is formed is reduced in thickness. In order to prevent such a reduced strength from occurring, the outside diameter of the internal gear 1 must be increased by a portion equal to a reduced portion of the thickness of the internal gear 1 caused by the recess groove formed thereon. However, it is not necessary for the internal gear 1 of the present invention to form a recess groove on the inner peripheral surface of the internal gear 1 between the internal gear part 1*c* and the bottom part 1*b*, and the thickness can be increased to that portion. Accordingly, the outside diameter of the internal gear 1 is not required to be increased and the internal gear 1 can be reduced in diameter.

The present invention should not be limited to the above embodiments but many changes and modifications can be made in accordance with necessity.

For example, in the above embodiments, the forming roll 5 is relatively revolved with respect to the raw material 2 by rotating the forming die 3. It is also accepted that the forming die 3 is non-rotatably fixed and the forming roll 5 is revolved around the raw material 2 about the axis of the forming die 3.

Moreover, although the forming roll 5 is moved in the axial direction of the forming die 3, it is also accepted that the forming roll 5 is positionally fixed and the forming die 3 is moved in the reverse direction to the moving direction of the forming roll 5 in the above embodiments.

INDUSTRIAL APPLICABILITY

This invention can be utilized as a method for forming an internal gear having a helical tooth. The internal gear formed by this forming method can be used as an internal gear of a planetary gear apparatus, for example.

The invention claimed is:

1. A method for forming an internal gear in which a cylindrical raw material is externally inserted onto a forming die with an outer gear part formed thereon and fixed to said forming die, a forming roll is relatively moved in an axial direction of said forming die with respect to said raw material with said forming roll press-contacted with an outer peripheral surface of said raw material and relatively revolved about the axis of said forming die such that an inner peripheral surface of said raw material is pressed against said outer gear part of said forming die, thereby forming an internal gear part on the inner peripheral surface of said raw material, wherein each tooth of said outer gear part of said forming die is formed in a helical tooth, an annular weir part having an inside diameter equal to or less than a tooth tip circle diameter of said internal gear part is formed on the inner peripheral surface of said raw material adjacent to a second end part of said outer gear part on a rear side in a moving direction of said forming roll, and said forming die is rotated such that a first end part of said outer gear part on a front side in the moving direction of said forming roll is moved ahead of the second end part of said outer gear part on the weir part side when said forming roll is fixed and said forming die is rotated.

2. A method for forming an internal gear according to claim 1, wherein a tooth tip circle diameter and a tooth bottom circle diameter of said outer gear part of said forming die are gradually reduced from one end side on the weir part side toward the other end side of said outer gear part, and the tooth thickness of said outer gear part is gradually reduced from one end side toward the other end side of said outer gear part in correspondence with the tooth tip circle diameter and tooth bottom circle diameter.

3. A method for forming an internal gear according to claim 1, wherein an annular forming surface having a circular configuration in section about an axis of said forming die is formed at a place more offset toward the weir part side from said outer gear part on the outer peripheral surface of said forming die, and said forming roll is relatively revolved with respect to said forming die with said forming roll stopped at a location corresponding to the annular forming surface, so that the inner peripheral surface of said raw material is pressed against the annular forming surface, thereby forming an annular reference surface on the inner peripheral surface of said internal gear.

4. A method for forming an internal gear according to claim 3, wherein said forming roll is relatively revolved in the normal and reverse directions at the time said forming roll is relatively revolved with respect to said forming die with said forming roll stopped at a location corresponding to the annular forming surface.

5. A method for forming an internal gear according to claim 1, wherein said forming roll is separated in the radial direction from an outer peripheral surface of said cylindrical part before said forming roll is escaped from the outer peripheral surface of said raw material on the front side in the moving direction of said forming roll.

6. A method for forming an internal gear according to claim 5, wherein said forming roll is relatively revolved a plurality of times with said forming roll stopped at a location where said forming roll is separated in the radial direction from the outer peripheral surface of said raw material.

7. An internal gear including a cylindrical part formed at an inner peripheral surface thereof with an internal gear part having a helical tooth part, and a bottom part formed on one end part of said cylindrical part, wherein an internal gear part is formed on the inner peripheral surface of said internal gear and said annular reference surface is formed on the inner peripheral surface of said internal gear part between said bottom part and said internal gear part in accordance with the following forming steps A and B:

A. wherein a cylindrical raw material is externally inserted onto a forming die formed with an outer gear part and fixed thereto, a forming roll is relatively moved in the axial direction of said forming die with respect to said raw material with said forming roll press contacted with the outer peripheral surface of said raw material and relatively revolved about the axis of said forming die, so that the inner peripheral surface of said raw material is pressed against said outer gear part of said forming die, thereby forming an internal gear part on the inner peripheral surface of said raw material, each tooth of said outer gear part of said forming die is formed in a helical tooth, and an annular weir part having an inside diameter equal to or less than a tooth tip circle diameter of said internal gear part is formed on the inner peripheral surface of said raw material adjacent to a second end part of said outer gear part on a rear side in a moving direction of said forming roll, and said forming die is rotated such that a first end part of said outer gear part on a front side in the moving direction of said forming roll is moved ahead of the second end part of said outer gear part on the weir part side when said forming roll is fixed and said forming die is rotated, thereby forming said internal gear part and B. wherein said forming die is formed at a place more offset toward the weir part side from said outer gear part on the outer peripheral surface with an annular forming surface having a circular configuration in section about an axis of said forming die, and said forming roll is relatively revolved with respect to said forming die with said forming roll stopped at a location corresponding to the annular forming surface, so that the inner peripheral surface of said raw material is pressed against the annular forming surface, thereby forming an annular reference surface on the inner peripheral surface of said internal gear.

* * * * *